US007954801B2

(12) United States Patent
Fukami

(10) Patent No.: US 7,954,801 B2
(45) Date of Patent: Jun. 7, 2011

(54) SIDE POSITION STAPLER FOR POST-PROCESSING DEVICE

(75) Inventor: Kentaro Fukami, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 19 days.

(21) Appl. No.: 12/458,576

(22) Filed: Jul. 16, 2009

(65) Prior Publication Data

US 2010/0019435 A1 Jan. 28, 2010

(30) Foreign Application Priority Data

Jul. 23, 2008 (JP) ..... 2008-189607
Feb. 6, 2009 (JP) ..... 2009-025702

(51) Int. Cl.
*B65H 37/04* (2006.01)

(52) U.S. Cl. ..... 270/58.11; 270/58.12; 270/58.17

(58) Field of Classification Search ..... 270/58.11, 270/58.12, 58.16, 58.17; 271/220, 221
See application file for complete search history.

(56) References Cited

U.S. PATENT DOCUMENTS 5,938,186 A * 8/1999 Sato et al. ..... 270/58.11
6,427,997 B1 * 8/2002 Hirota et al. ..... 270/58.12
6,527,269 B2 3/2003 Yamada et al.
6,561,503 B1 * 5/2003 Ogata et al. ..... 270/58.12
6,871,851 B2 3/2005 Tamura et al.
6,889,974 B2 5/2005 Tamura et al.
7,014,183 B2 3/2006 Tamura et al.
7,182,333 B2 2/2007 Tamura et al.
7,192,020 B2 * 3/2007 Hayashi et al. ..... 270/58.11
7,300,052 B2 11/2007 Tamura et al.
7,380,786 B2 6/2008 Tamura et al.
7,392,983 B2 * 7/2008 Kodama et al. ..... 271/249
7,441,771 B2 10/2008 Tamura et al.
7,451,980 B2 11/2008 Tamura et al.
7,566,051 B2 7/2009 Kodama et al.

FOREIGN PATENT DOCUMENTS

CN 1601392 3/2005
JP 2007-031134 2/2007

OTHER PUBLICATIONS

Chinese Office Action dated Sep. 27, 2010 and English translation thereof.

* cited by examiner

*Primary Examiner* — Patrick Mackey
(74) *Attorney, Agent, or Firm* — Harness, Dickey & Pierce, P.L.C.

(57) ABSTRACT

A sheet post-processing device receives a sheet from an image forming apparatus conveys a plurality of the sheets to a staple tray to form a sheet pile, and staples the sheet pile with a stapler. The stapler is arranged along a first side of the staple tray in a sheet width direction and has an opening for taking in a second side of the sheet pile when stapling the sheet pile at a staple position. The stapler unit is arranged at a position that a central portion of the second side of the sheet pile is situated inside the opening, and the staple position is located downstream of an alignment surface of an aligning member in a sheet conveying direction that aligns ends of the sheets in the sheet pile.

5 Claims, 13 Drawing Sheets

SIDE POSITION STAPLER FOR POST-PROCESSING DEVICE

CROSS-REFERENCE TO RELATED APPLICATIONS

The present application claims priority to and incorporates by reference the entire contents of Japanese Patent Application No. 2008-189607 filed in Japan on Jul. 23, 2008 and Japanese Patent Application No. 2009-025702 filed in Japan on Feb. 6, 2009.

BACKGROUND OF THE INVENTION

1. Field of the Invention

The present invention relates to a sheet post-processing device that processes sheets output from an image forming apparatus.

2. Description of the Related Art

Japanese Patent Application Laid-open No. 2007-31134 discloses a sheet post-processing device that receives a sheet from an image forming apparatus, temporarily piles sheets on a staple tray, staples an end of the sheet pile if required, and discharges the stapled sheet pile out of the sheet post-processing device. In this sheet post-processing device, a stapler that staples the sheet pile is arranged upstream of the staple tray in a sheet conveying direction.

However, arrangement of the stapler upstream of the staple tray in the sheet conveying direction disadvantageously leads to an increase in the length of the sheet post-processing device in the sheet conveying direction.

SUMMARY OF THE INVENTION

It is an object of the present invention to at least partially solve the problems in the conventional technology.

According to an aspect of the present invention, there is provided a sheet post-processing device that receives a sheet from an image forming apparatus and, directly discharges the sheet to outside when no post-processing is to be performed on the sheet, performs post-processing on the sheet and discharges post-processed sheet to outside when post-processing is to be performed on the sheet. The sheet post-processing unit includes a tray member configured to accumulate a plurality of the sheet as a sheet pile, the tray member having a first side that is parallel to a sheet width direction; an end aligning member having an end alignment surface configured to align trailing ends of the sheets in the sheet pile; and a stapler unit is configured to staple together the sheet pile at a second side thereof at a staple position, the stapler unit having an opening in which the second side of the sheet pile is inserted. The stapler unit is arranged near the first side of the tray member such that a central portion of the second side of the sheet pile is situated inside the opening of the stapler unit, and the staple position is located downstream of the alignment surface of the aligning member in a sheet conveying direction.

According to another aspect of the present invention, there is provided an image forming system that includes an image forming apparatus that forms an image onto a sheet based on image data; and the above sheet post-processing device. The sheet post-processing device receives the sheet with the image from the image forming apparatus and further processes the sheet if required.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 16:
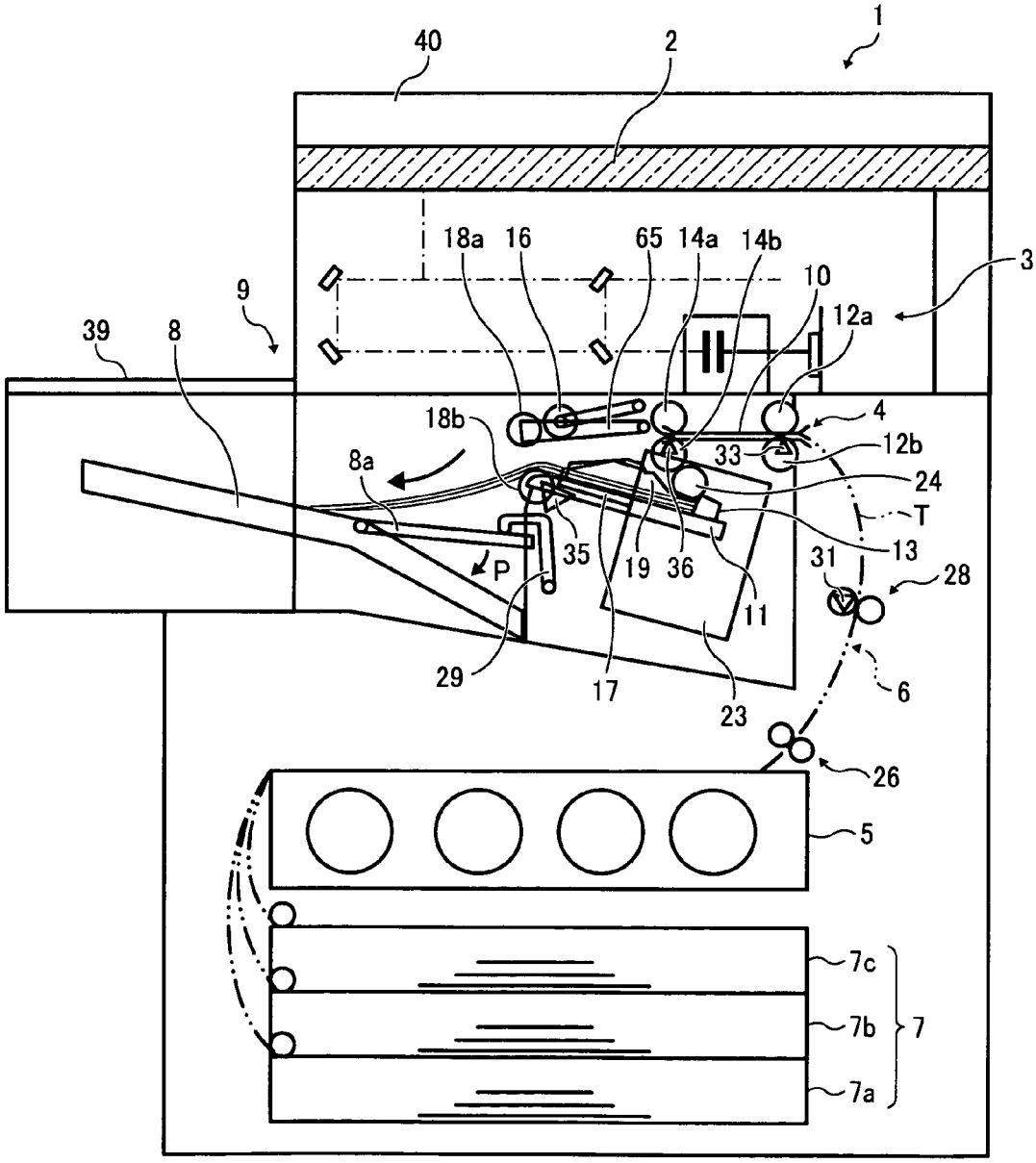
FIG. 16 is a side view of the internal configuration of an image forming system according to the first embodiment.

Exemplary embodiments of the present invention are described in detail below with reference to the accompanying drawings. An image forming system 1 according to a first embodiment of the present invention includes, as illustrated in FIG. 16, a scanning unit (scanning device) 3 that scans an image from an original that is placed on an exposure glass 2; an image forming unit (image forming apparatus) 5 that forms the image that is obtained by the scanning unit 3 on a sheet T; a sheet supply unit 7 that supplies the sheet T to the image forming unit 5; and a sheet post-processing unit (sheet post-processing device) 9 that receives the sheet T on which the image is formed from the image forming unit 5, post-processes (e.g., staples) the sheet T if required, and discharges the post-processed sheet T out of the sheet post-processing unit 9. A platen 40 is provided onto the exposure glass 2 with a hinge in such a manner that the platen 40 can open and close.

The image forming system 1 includes an operation unit 37 that sends an operation signal, such as a paper-feed signal, to a later-described control unit 27. The operation signal is sent to the control unit 27 in response to an instruction that is received via a control panel 39 that is arranged adjacent to the scanning unit 3. A user can select a size of a sheet to be supplied to the image forming unit 5 and decide various settings including the number of copies via the control panel 39.

The image forming unit 5 includes an image carrier on which an electrostatic latent image corresponding to the image obtained by the scanning unit 3 is formed; a developing unit that develops the electrostatic latent image on the image carrier with toner, thereby forming a toner image; a transferring unit that transfers the toner image onto the sheet T; and a fixing unit that fixes the transferred toner image onto the sheet T.

The scanning unit 3 includes an exposure lamp and a plurality of mirrors. The exposure lamp emits light to the original. The mirrors receive the light reflected from the original, and guide the light to the image carrier.

The sheet supply unit 7 includes sheet cassettes 7*a*, 7*b*, and 7*c* that are arranged in this order with the sheet cassette 7*a* being at the bottom. The sheet cassette 7*a* accommodates B5-sized sheets as the sheet T. The sheet cassette 7*b* accommodates B4-sized sheets as the sheet T. The sheet cassette 7*c* accommodates A4-sized sheets as the sheet T.

The sheet post-processing unit 9 is arranged between the scanning unit 3 that is located in an upper part of the image forming system 1 and the image forming unit 5 that is located in a lower part of the image forming system 1.

A post-processing-unit conveyer path 6 is arranged inside a housing of the image forming system 1. The sheet T on which the image is formed is conveyed from the image forming unit 5 to the sheet post-processing unit 9 through the post-processing-unit conveyer path 6. A pair of conveyer rollers 26 is arranged upstream in the post-processing-unit conveyer path 6. A pair of conveyer rollers 28 and a sheet leading-end sensor 31 are arranged in the middle of the post-processing-unit conveyer path 6. The sheet leading-end sensor 31 detects an edge of the sheet.

A downstream end of the post-processing-unit conveyer path 6 in the sheet conveying direction is connected to a sheet entrance port 4 of the sheet post-processing unit 9.

The sheet post-processing unit 9 includes a staple tray 11 and a discharge tray 8. If the sheet T is to be post-processed, after conveyed from the image forming unit 5, the sheet T is conveyed onto the staple tray 11, and temporarily placed on the staple tray 11. After post-processed (stapled), the sheet T is discharged onto the discharge tray 8. If no post-processing is to be carried out, the sheet T is directly conveyed onto the discharge tray 8.

A discharge path 10 extends downstream of the sheet entrance port 4 in a substantially horizontal manner. The discharge path 10 guides the sheet T from the sheet entrance port 4 to either the staple tray 11 or the discharge tray 8.

A pair of entrance rollers 12*a* and 12*b* is arranged upstream in the discharge path 10. A pair of staple-tray entrance rollers 14*a* and 14*b* is arranged in the discharge path 10. A sheet trailing-end sensor 33 that detects a trailing end Tc of the sheet T is arranged near a nip between the entrance rollers 12*a* and 12*b*. The entrance roller 12*a* is a driving roller while the entrance roller 12*b* is a driven roller.

Figure 1:
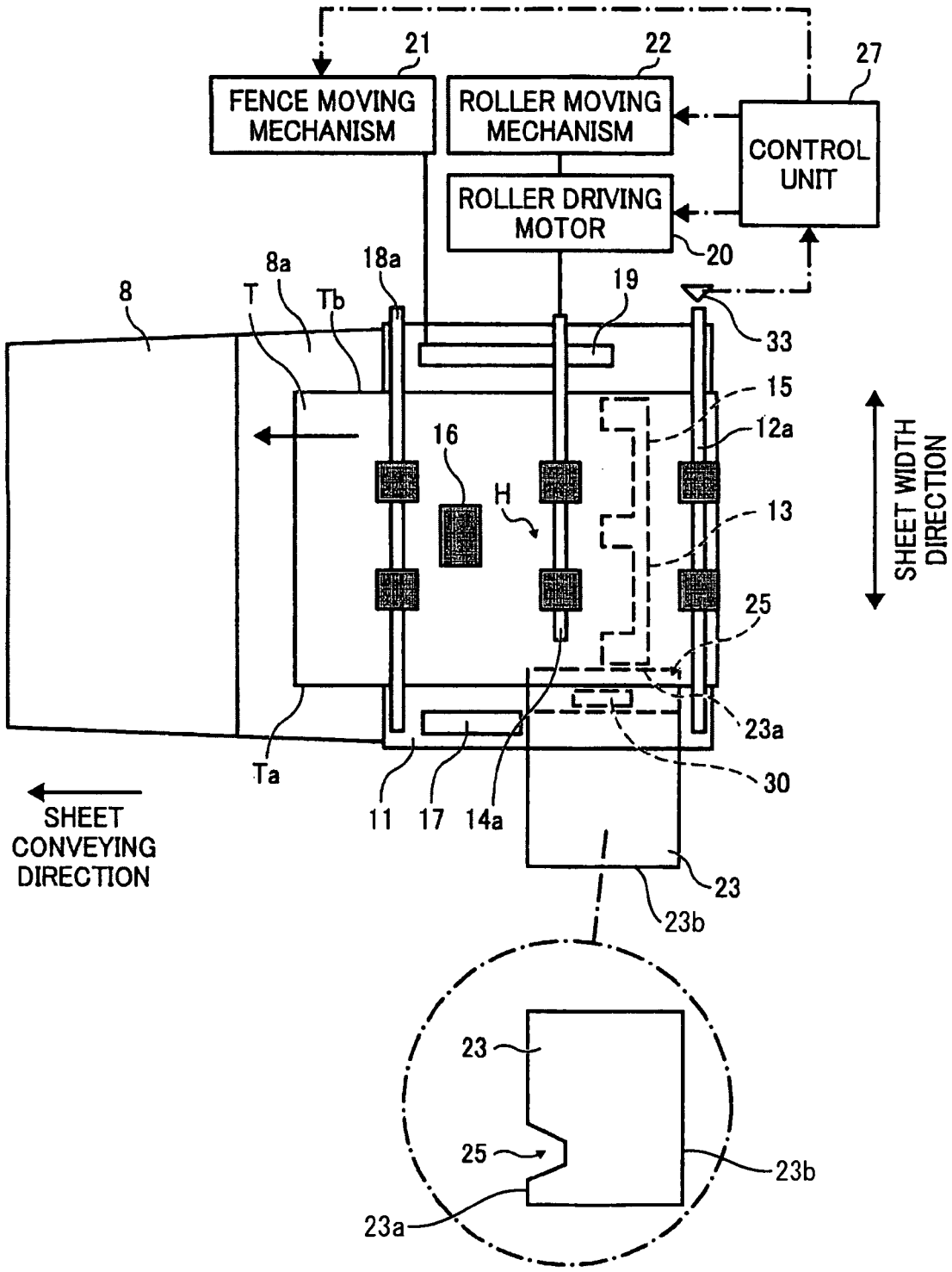
FIG. 1 is a schematic diagram including a top view of a staple tray and relevant parts of a sheet post-processing unit according to a first embodiment of the present invention for explaining a state before a B4-sized sheet is moved in a sheet width direction, and an enlarged view of a stapler viewed from a sheet conveying direction.

The staple-tray entrance roller 14*a* is a driving roller. As illustrated in FIG. 1, the staple-tray entrance roller 14*a* is a part of an assembly that includes a driving shaft extending in a sheet width direction and the staple-tray entrance roller 14*a* and one more roller fixedly arranged on this driving shaft. The rollers in the staple-tray entrance roller assembly are arranged near the center of a width of the staple tray 11 in the sheet width direction, spaced from each other.

The staple-tray entrance roller 14*b* is a driven roller. An assembly to which the staple-tray entrance roller 14*b* belongs is not visible in FIG. 1. The structure of this assembly is similar to the assembly to which the staple-tray entrance roller 14*a* belongs. The structure of the entrance rollers 12*a* and 12*b* is similar to the structure of the staple-tray entrance roller 14*a*.

The staple-tray entrance roller 14*a* is rotated by a roller driving motor 20. More particularly, a gear (not shown) that is fixed to a driving shaft of the roller driving motor 20 is engaged with a gear that is fixed to the driving shaft of the staple-tray entrance roller 14*a*. Therefore, the staple-tray entrance roller 14*a* rotates when the roller driving motor 20 rotates. The driving shaft of the roller driving motor 20 and the driving shaft of the staple-tray entrance roller 14*a* are arranged parallel to each other. Those driving shafts are supported by a single bearing rotatably in such a manner that the driving shafts cannot move in a shaft extending direction.

The staple-tray entrance roller 14*a* can move together with the roller driving motor 20 in the sheet width direction away from a home position H by operation of a roller moving mechanism 22. The roller moving mechanism 22 includes a pinion (not shown), a stepping motor (not shown) that rotates the pinion, and a rack (not shown) that engages with the pinion and is attached to the bearing. The rack can move in the sheet width direction. The roller moving mechanism 22 is controlled by the control unit 27.

A tapping roller 16 is arranged downstream of the staple-tray entrance rollers 14*a* and 14*b*. The tapping roller 16 aligns the trailing end Tc of the sheet T that is conveyed onto the staple tray 11. The tapping roller 16 is rotatably supported by an end of an arm the other end of which is swingably supported by the housing. The tapping roller 16 can move between a contact position where the tapping roller 16 is in contact with a sheet surface and a non-contact position where the tapping roller 16 is away from the sheet surface. Rotation of the tapping roller 16 and swing of the arm that supports the tapping roller 16 are controlled by the later-described control unit 27.

A pair of discharge rollers 18 (18*a*, 18*b*) discharges the sheet T onto the discharge tray 8. The discharge roller 18*a* is a driving roller while the discharge roller 18*b* is a driven roller. The discharge roller 18*a* is arranged downstream of the tapping roller 16. The discharge roller 18*a* is rotatably supported by an end of a discharge-roller supporting arm 65 the other end of which is swingably supported by the housing. The discharge roller 18*a* can move between a discharge position where the discharge roller 18*a* is in contact with the sheet surface and a non-discharge position where the discharge roller 18*a* is away from the sheet surface. The discharge-roller supporting arm 65 and the arm that supports the tapping roller 16 do not interfere with each other, even when those arms are swinging. Rotation of the discharge roller 18*a* and swinging of the discharge-roller supporting arm 65 are controlled by the later-described control unit 27.

The discharge roller 18*b* is arranged opposed to the discharge roller 18*a* and downstream of the staple tray 11 in the sheet conveying direction. A sheet discharge sensor 35 is arranged near a nip between the discharge rollers 18*a* and 18*b*.

The staple tray 11 is arranged under the staple-tray entrance rollers 14*a* and 14*b* on an inclined plane with an upstream end of the staple tray 11 being lower than a downstream end of the staple tray 11.

A back-end fence 13 is attached to the staple tray 11 near the upstream end in the sheet conveying direction. The back-end fence 13 is used to align the trailing end Tc of the sheet T that is conveyed onto the staple tray 11.

A cross section of the back-end fence 13 is shaped like a bracket. As illustrated in FIG. 1, the back-end fence 13 has a trailing-end receiving surface 15 that receives the trailing end Tc. The trailing-end receiving surface 15 is an inner surface of a longitudinal side of the bracket. The back-end fence 13 is arranged in such a manner that the longitudinal side extends in the sheet width direction and the bracket opens toward downstream in the sheet conveying direction.

A reverse roller 24 that aligns the trailing end Tc is arranged above the staple tray 11 immediately near the downstream side of the back-end fence 13. The reverse roller 24 is controlled by the later-described control unit 27.

A side fence 17 that is used to align the sheet sides is arranged on a first side of the staple tray 11 in the sheet width direction. A surface of the side fence 17 is arranged substantially perpendicular to the surface of the staple tray 11. The side fence 17 is arranged in such a manner that a longitudinal side is perpendicular to the sheet width direction.

A jogger fence 19 that is used to align the sheet sides is arranged on a second side of the staple tray 11 in the sheet width direction. A surface of the jogger fence 19 is arranged substantially perpendicular to the surface of the staple tray 11, and substantially parallel to the surface of the side fence 17. That is, a longitudinal side of the jogger fence 19 is perpendicular to the sheet width direction. The jogger fence 19 can move in the sheet width direction by operation of a fence moving mechanism 21. A home position of the jogger fence 19 is set away from the side fence 17 as far as possible.

The fence moving mechanism 21 includes a pinion, a rack that engages with the pinion and is attached to the jogger fence 19, and a stepping motor that rotates the pinion. The rack can move in the sheet width direction.

A stapler 23 is arranged on the first side of the staple tray 11 near an upstream end of the side fence 17 in the sheet conveying direction. The stapler 23 staples an end of the sheet pile that is placed on the staple tray 11.

The stapler 23 is arranged in such a manner that an opening 25 from which the sheets are inserted to the stapler 23 opens toward the center of the sheet width, and a staple position 30 as a target position to be stapled is set downstream of the trailing-end receiving surface 15 of the back-end fence 13 in the sheet conveying direction. The opening 25 is provided to a first stapler end 23*a* of the stapler 23.

The first stapler end 23*a* is closer to the center of the sheet width of the staple tray 11 (closer to the jogger fence 19) than a first side Ta of the sheet T is, if the sheet T is A3 size or B4 size. Assume that the sheet post-processing unit 9 cannot receive a sheet larger than the A3 sheet.

The discharge tray 8 includes a swinging member 8*a* that forms a part of a surface of the discharge tray 8. An end of the swinging member 8*a* is supported by a shaft extending along a width of the discharge tray 8 in the sheet width direction, and the other end of the swinging member 8*a* is positioned near an upstream end of the discharge tray 8 in the sheet conveying direction. When the swinging member 8*a* swings in a direction indicated by an arrow P illustrated in FIG. 16, the sheet T that is placed on the discharge tray 8 moves toward the upstream end of the discharge tray 8 due to the weight of the sheet T. The swinging member 8*a* is always pushed upward by a coil spring force, and is stopped by a later-described back-end stopper 29 directly or via the sheet T. The swinging member 8*a* swings in the direction indicated by the arrow P, when a solenoid is ON. The swinging member 8*a* swings in the direction reverse to the direction indicated by the arrow P, when the solenoid is OFF. The swinging member 8*a* is controlled by the control unit 27.

The back-end stopper 29 is swingably arranged under the discharge roller 18*b*, opposed to the swinging member 8*a*. The back-end stopper 29 stops the trailing end Tc of the sheet T that is placed on the discharge tray 8. The back-end stopper 29 is always pushed by a coil spring force toward a stop position. The stop position is a position at which, if no sheet is placed on the discharge tray 8, the swinging member 8*a* is in contact with the back-end stopper 29. The back-end stopper 29 swings away from the stop position to a release position, when a solenoid is ON. The back-end stopper 29 swings from the release position to the stop position, when the solenoid is OFF.

Figure 15:
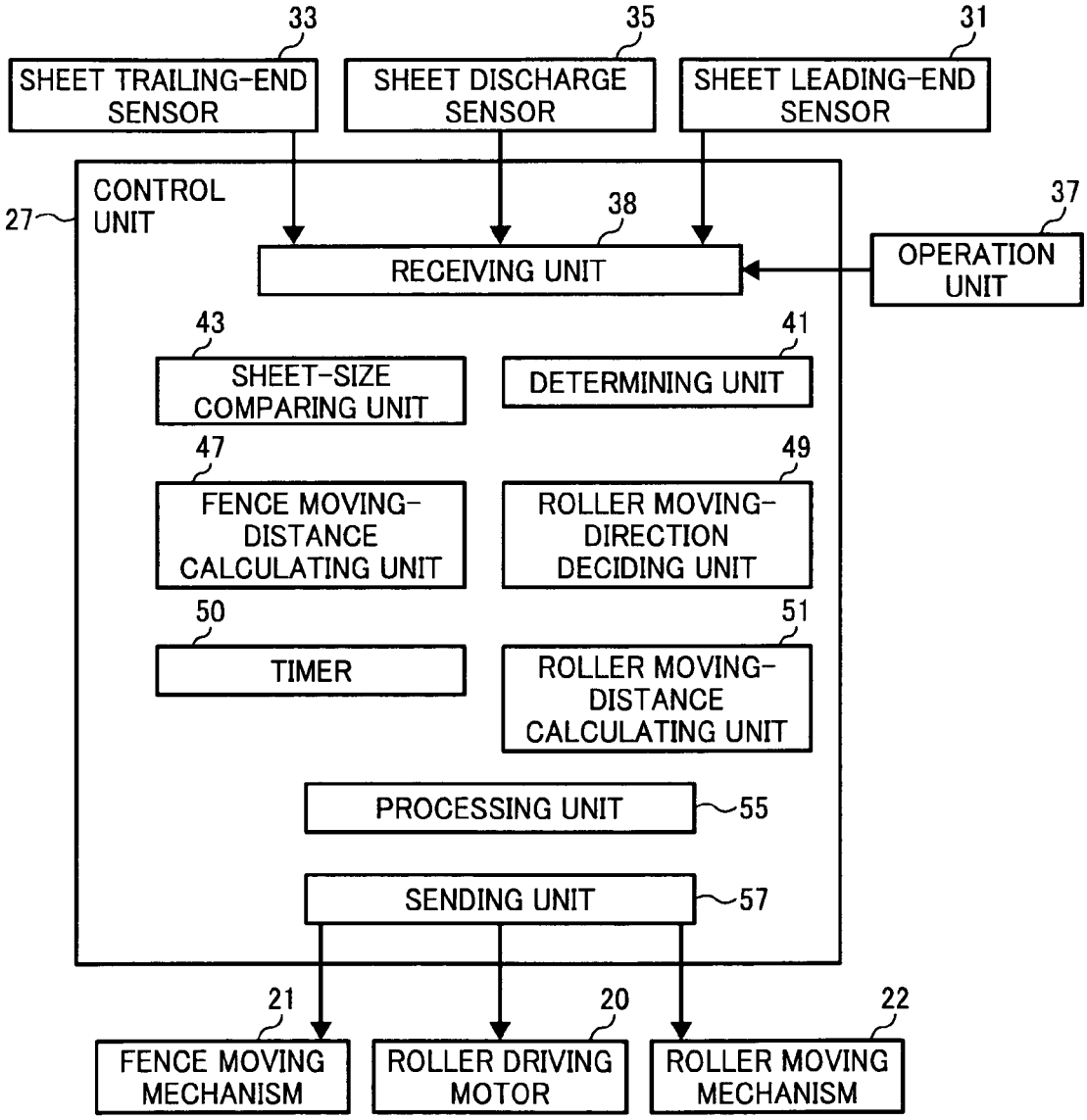
FIG. 15 is a functional block diagram of the sheet post-processing unit according to the first embodiment.

The configuration of the control unit 27 is described with reference to FIG. 15. A receiving unit 38 receives signals from the sheet leading-end sensor 31, the sheet trailing-end sensor 33, the sheet discharge sensor 35, and the operation unit 37. A determining unit 41 determines a current situation based on information that is received from the receiving unit 38.

A sheet-size comparing unit 43 compares a sheet size that is selected via the control panel 39 with a reference sheet size. Assume that the reference sheet size is B4 size.

A roller moving-direction deciding unit 49 decides a direction in which the staple-tray entrance rollers 14*a* and 14*b* are to be moved (hereinafter, "roller moving direction") from a result of the comparison by the sheet-size comparing unit 43. More particularly, if the selected sheet size is equal to or larger than the reference sheet size, the roller moving direction is decided as the sheet width direction toward the second side Tb of the staple tray 11 (i.e., toward the jogger fence 19). If the selected sheet size is smaller than the reference sheet size, the roller moving direction is decided as the sheet width direction toward the first side Ta of the staple tray 11 (i.e., toward the side fence 17).

A roller moving-distance calculating unit 51 calculates a moving distance U by which the staple-tray entrance rollers

14*a* and 14*b* are to be moved according to the sheet size that is selected via the control panel 39. The moving distance U is decided in such a manner that a distance between the first side Ta and the first stapler end 23*a* of the stapler 23 in the sheet width direction becomes M with the first side Ta being closer to the jogger fence 19 than the first stapler end 23*a* is. The distance M is several millimeters. More particularly, if the sheet T is equal to or larger than the reference sheet size, the calculated moving distance U is a sum of the distance M and a distance between the first side Ta and the first stapler end 23*a* in the sheet width direction that is measured before the sheet T is moved in the sheet width direction. If the sheet T is smaller than the reference sheet size, the calculated moving distance U is a difference between the distance M and the distance between the first side Ta and the first stapler end 23*a* in the sheet width direction that is measured before the sheet T is moved in the sheet width direction.

A fence moving-distance calculating unit 47 calculates a moving distance V between the home position of the jogger fence 19 and a target position to which the jogger fence 19 is to be moved to receive the sheet T (hereinafter, "sheet receiving position") from the sheet size that is selected via the control panel 39, the roller moving direction, and the moving distance U. More particularly, the moving distance V is decided in such a manner that, after the sheet T is moved in the sheet width direction by the staple-tray entrance rollers 14*a* and 14*b*, a distance between a second side Tb, which is opposite to the first side Ta, and the jogger fence 19 in the sheet width direction becomes N. The distance N is several millimeters. If the sheet T is equal to or larger than the reference sheet size, the calculated moving distance V is a value that is obtained by subtracting a sum of the moving distance U and the distance N from a distance between the second side Tb and the home position of the jogger fence 19 that is measured before the sheet T is moved in the sheet width direction. If the sheet T is smaller than the reference sheet size, the moving distance V is a value that is obtained by subtracting the distance N from the sum of the moving distance U and the distance between the second side Tb and the home position of the jogger fence 19 that is measured before the sheet T is moved in the sheet width direction.

A processing unit 55 performs processes according to the determination made by the roller moving-direction deciding unit 49, results of the calculation by the roller moving-distance calculating unit 51 and the fence moving-distance calculating unit 47.

A sending unit 57 sends contents of the processes performed by the processing unit 55 to the fence moving mechanism 21, the roller moving mechanism 22, and the roller driving motor 20. The control unit 27 includes a timer 50.

The image forming system 1 has three modes including a direct discharge mode in which after the sheet T is conveyed from the image forming unit 5, the sheet T is directly discharged without being subjected to any post-process; an alignment mode in which the sheet T is conveyed onto the staple tray 11, the trailing end Tc and the sides are aligned on the staple tray 11, and the aligned sheet pile is discharged; and a stapling mode in which the sheet pile is stapled on the staple tray 11 after the alignment, and the stapled sheet pile is discharged. The user selects one of the modes with the control panel 39.

The operation of the image forming system 1 is described with four different cases. In a first case that is described below, the user selects the B4-sized sheet as the sheet T and the stapling mode with the control panel 39.

The user opens the platen 40, places the original on the exposure glass 2, and closes the platen 40. The user inputs various settings via the control panel 39, more particularly, selects the B4-sized sheet as the sheet T and specifies the number of copies. After that, the user presses a paper feed button. When the image forming system 1 receives the paper-feed signal, the scanning unit 3 scans the image from the original, and the B4-sized sheet is conveyed as the sheet T from the sheet cassette 7*b* to the image forming unit 5. The image that is obtained by the scanning unit 3 from the original is formed on the sheet T. The sheet T on which the image is formed is conveyed to the sheet post-processing unit 9 via the post-processing-unit conveyer path 6.

The operation of the sheet post-processing unit 9 is described below. The sheet-size comparing unit 43 compares the sheet size (B4 size) that is selected via the control panel 39 with the reference sheet size (B4 size). Because the selected sheet size is equal to or larger than the reference sheet size, the roller moving-direction deciding unit 49 decides the roller moving direction in which the staple-tray entrance rollers 14*a* and 14*b* are to be moved as the sheet width direction toward the jogger fence 19. The roller moving-distance calculating unit 51 calculates the moving distance U by which the staple-tray entrance rollers 14*a* and 14*b* are to be moved in such a manner that, after the sheet T is moved, the distance between the first side Ta and the first stapler end 23*a* in the sheet width direction in the sheet width direction becomes M. The fence moving-distance calculating unit 47 calculates the moving distance V between the home position and the sheet receiving position of the jogger fence 19 in such a manner that, after the sheet T is moved, the distance between the second side Tb and the jogger fence 19 in the sheet width direction becomes N. With this configuration, a distance by which the jogger fence 19 is to be moved to align the sheet sides is fixed to a sum of M, N, and L, regardless of the sheet size, where L is distance between the sheet receiving surface of the side fence 17 and the first stapler end 23*a* in the sheet width direction.

Figure 2:
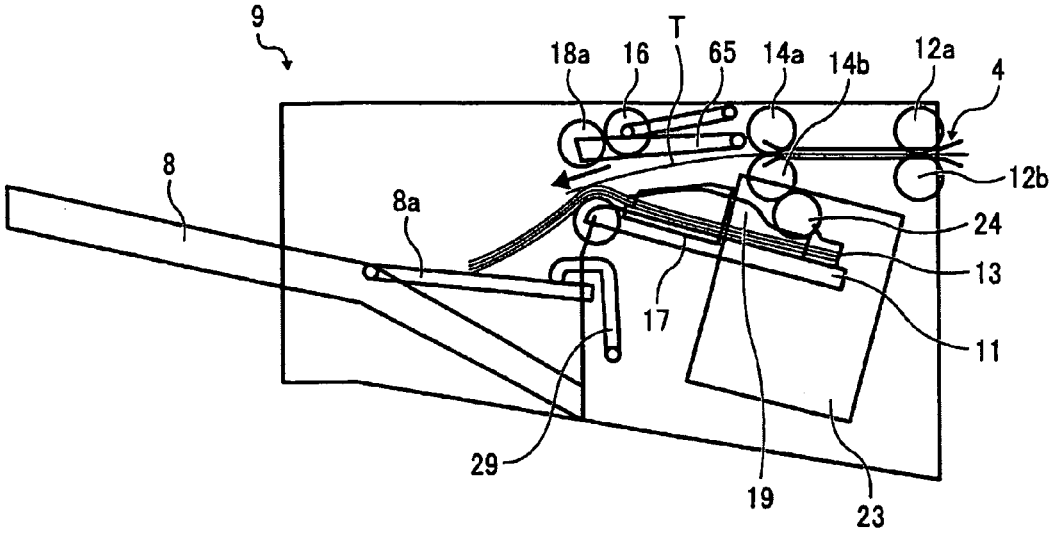
FIG. 2 is a side view of internal configuration of the sheet post-processing unit according to the first embodiment viewed from the sheet width direction for explaining a state where the B4-sized sheet is conveyed onto the staple tray.
Figure 3:
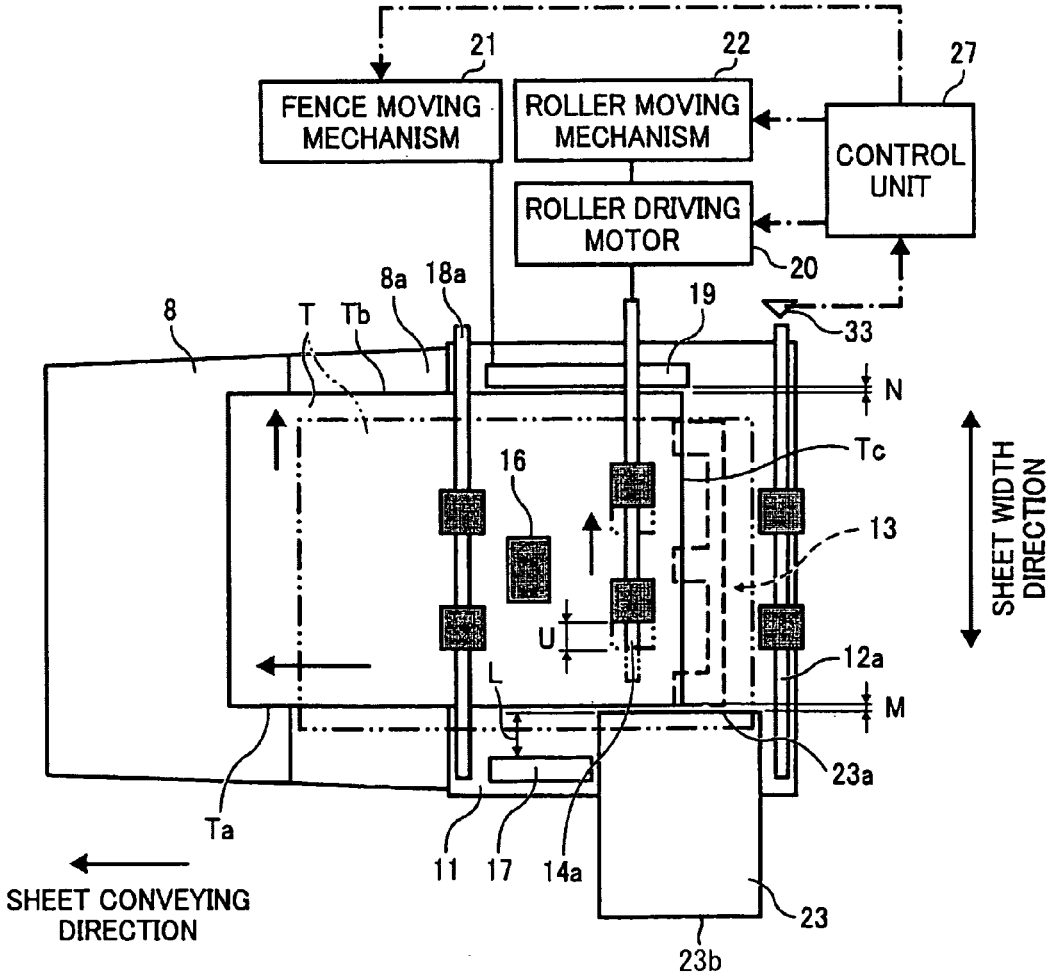
FIG. 3 is a top view of the staple tray and the relevant parts according to the first embodiment for explaining a state after the B4-sized sheet is moved in the sheet width direction.
Figure 4:
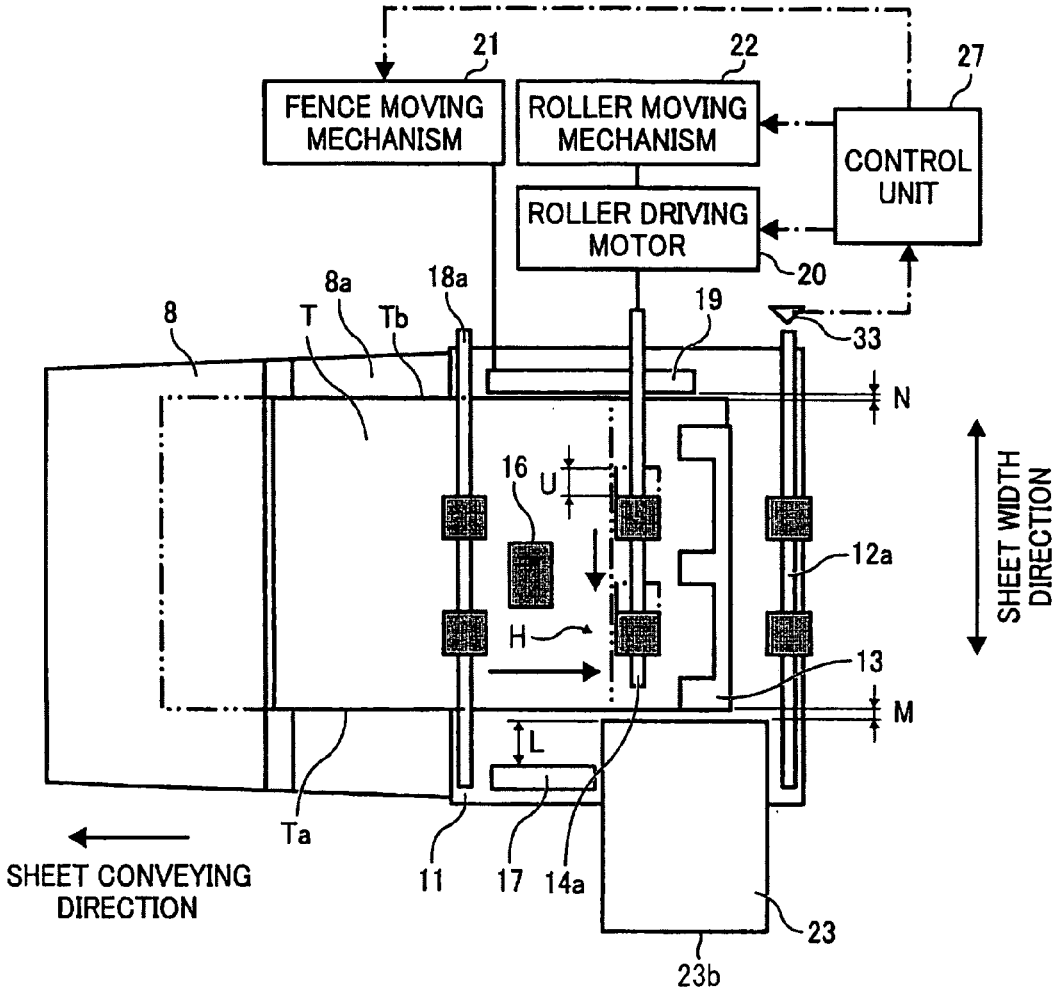
FIG. 4 is a top view of the staple tray and the relevant parts according to the first embodiment for explaining a state where the trailing end of the B4-sized sheet is aligned.
Figure 5:
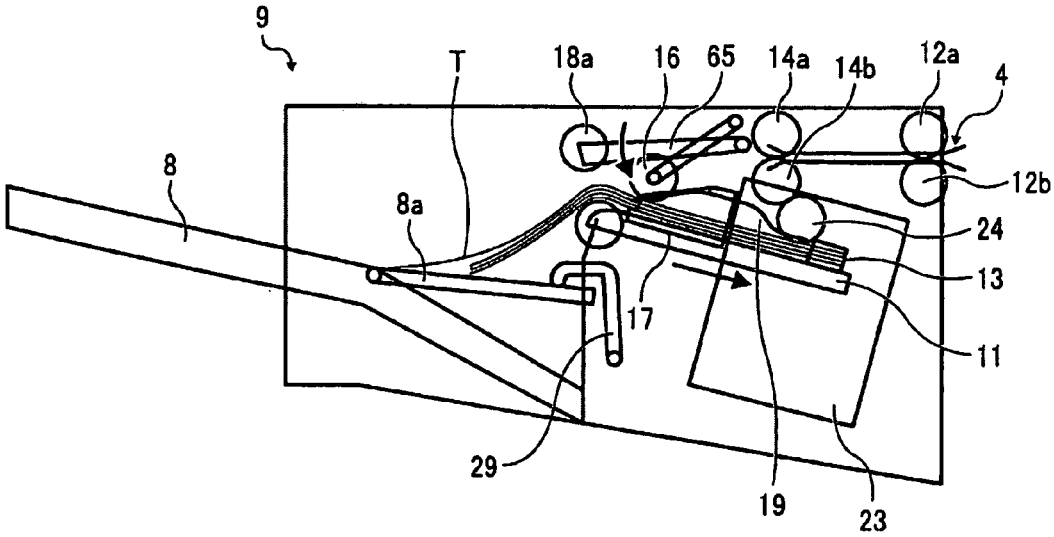
FIG. 5 is a side view of the internal configuration of the sheet post-processing unit according to the first embodiment viewed from the sheet width direction for explaining a state where the trailing end of the B4-sized sheet is aligned.
Figure 6:
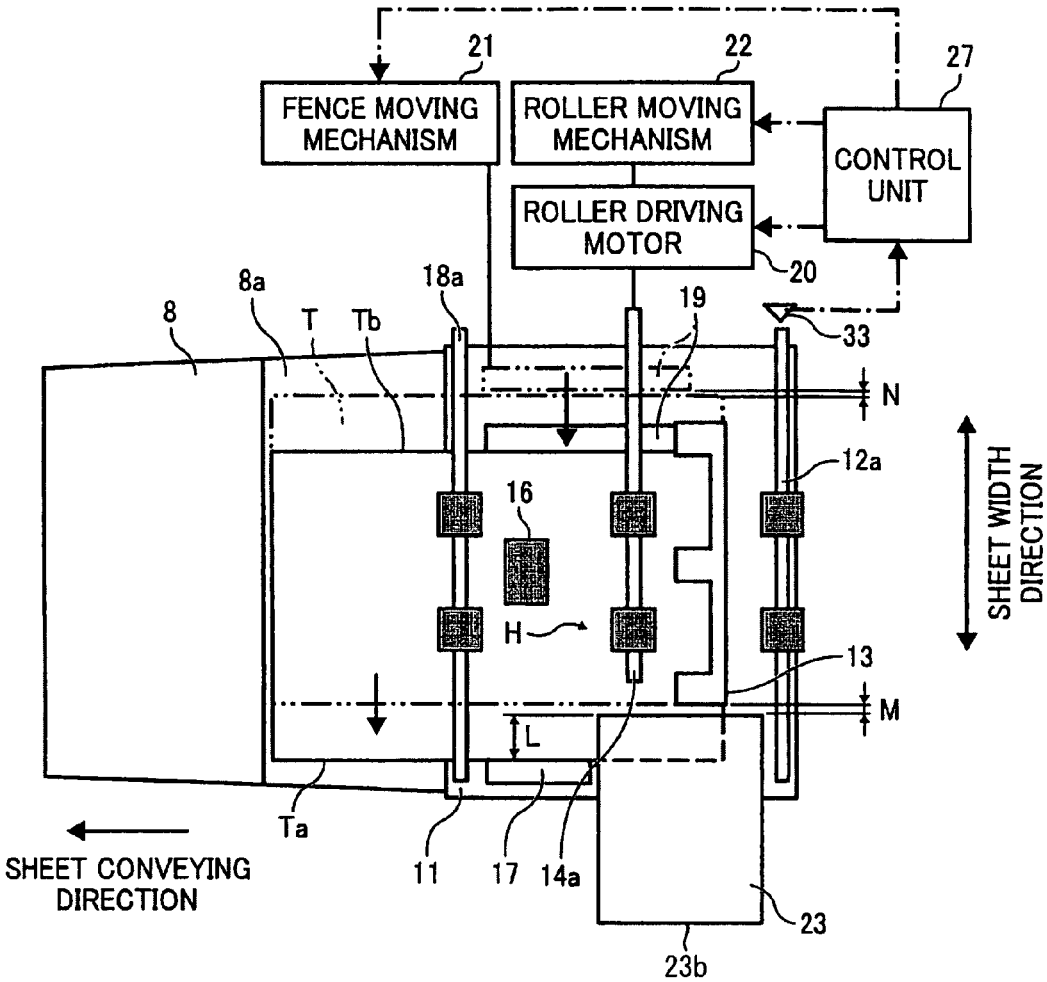
FIG. 6 is a top view of the staple tray and the relevant parts according to the first embodiment for explaining a state where the sides of the B4-sized sheet are aligned.
Figure 7:
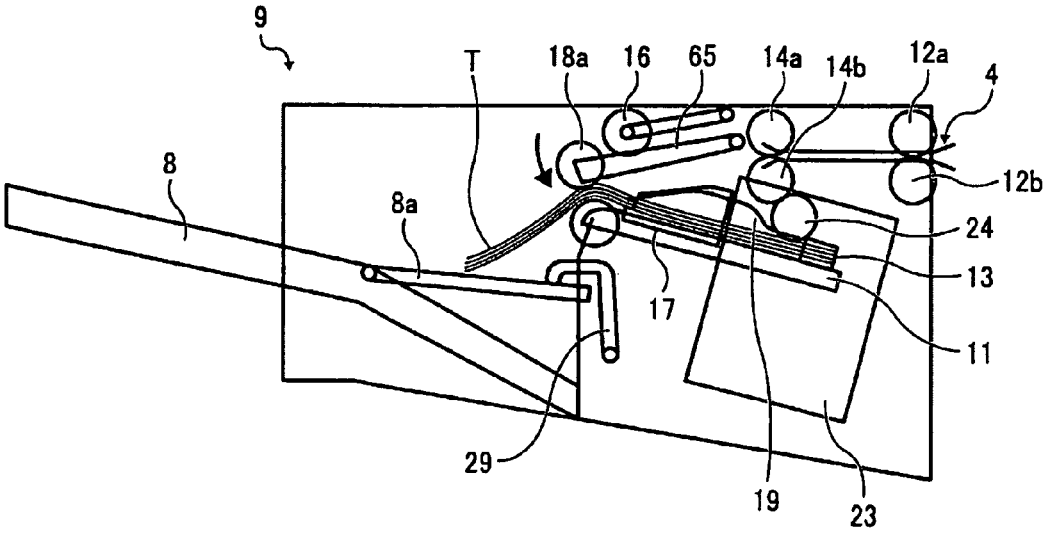
FIG. 7 is a side view of the internal configuration of the sheet post-processing unit according to the first embodiment viewed from the sheet width direction for explaining a state where a sheet pile of B4-sized sheets is being conveyed from the staple tray.
Figure 8:
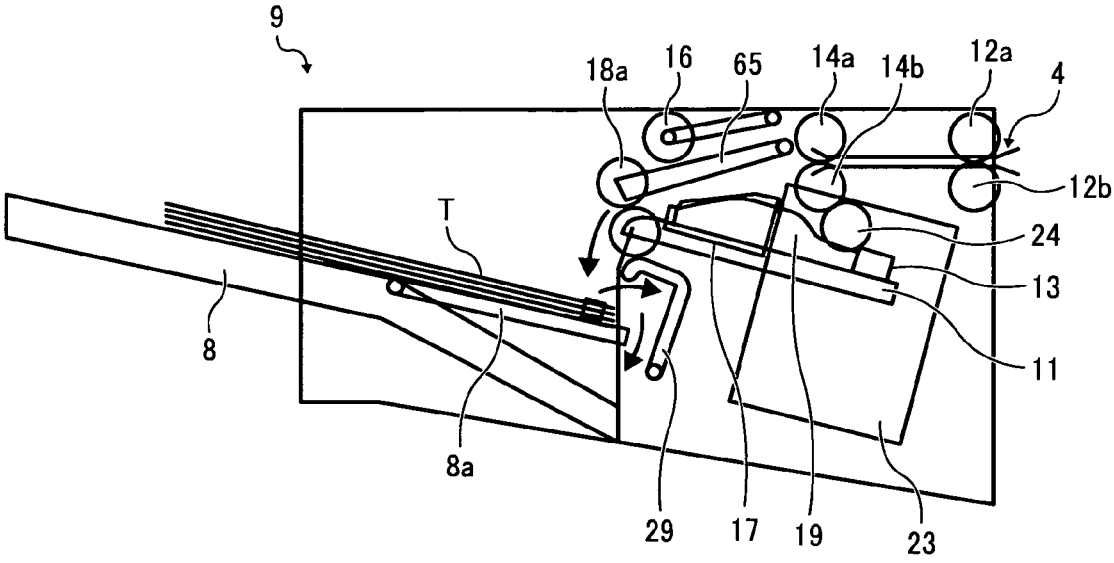
FIG. 8 is a side view of the internal configuration of the sheet post-processing unit according to the first embodiment viewed from the sheet width direction for explaining a state after the sheet pile of the B4-sized sheets is conveyed from the staple tray.
Figure 9:
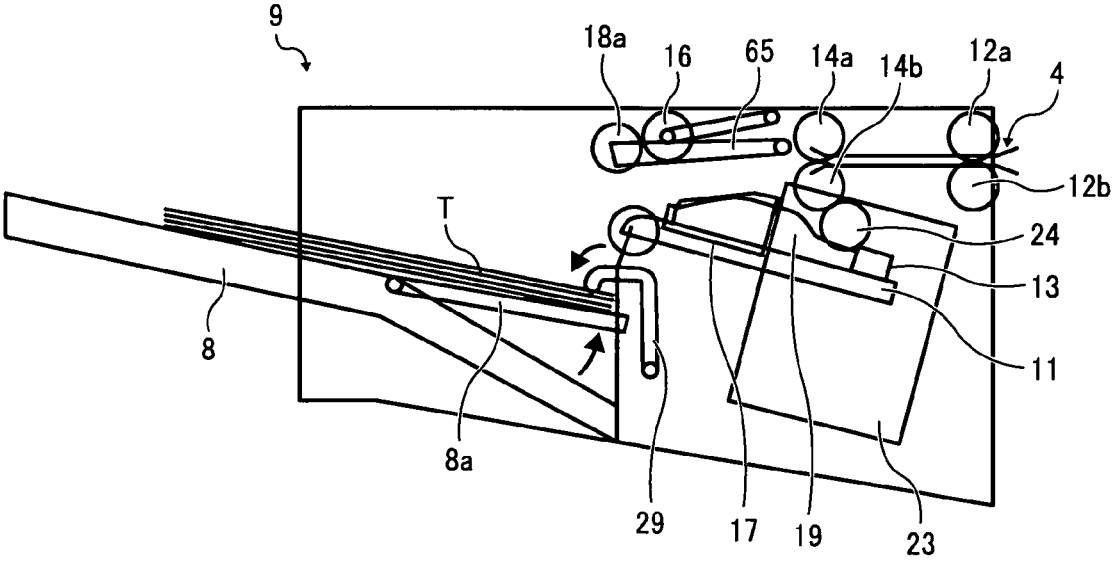
FIG. 9 is a side view of the internal configuration of the sheet post-processing unit according to the first embodiment viewed from the sheet width direction, for explaining a state where, after the sheet pile is conveyed from the staple tray, the trailing end of the sheet pile of the B4-sized sheets is stopped.
Figure 14:
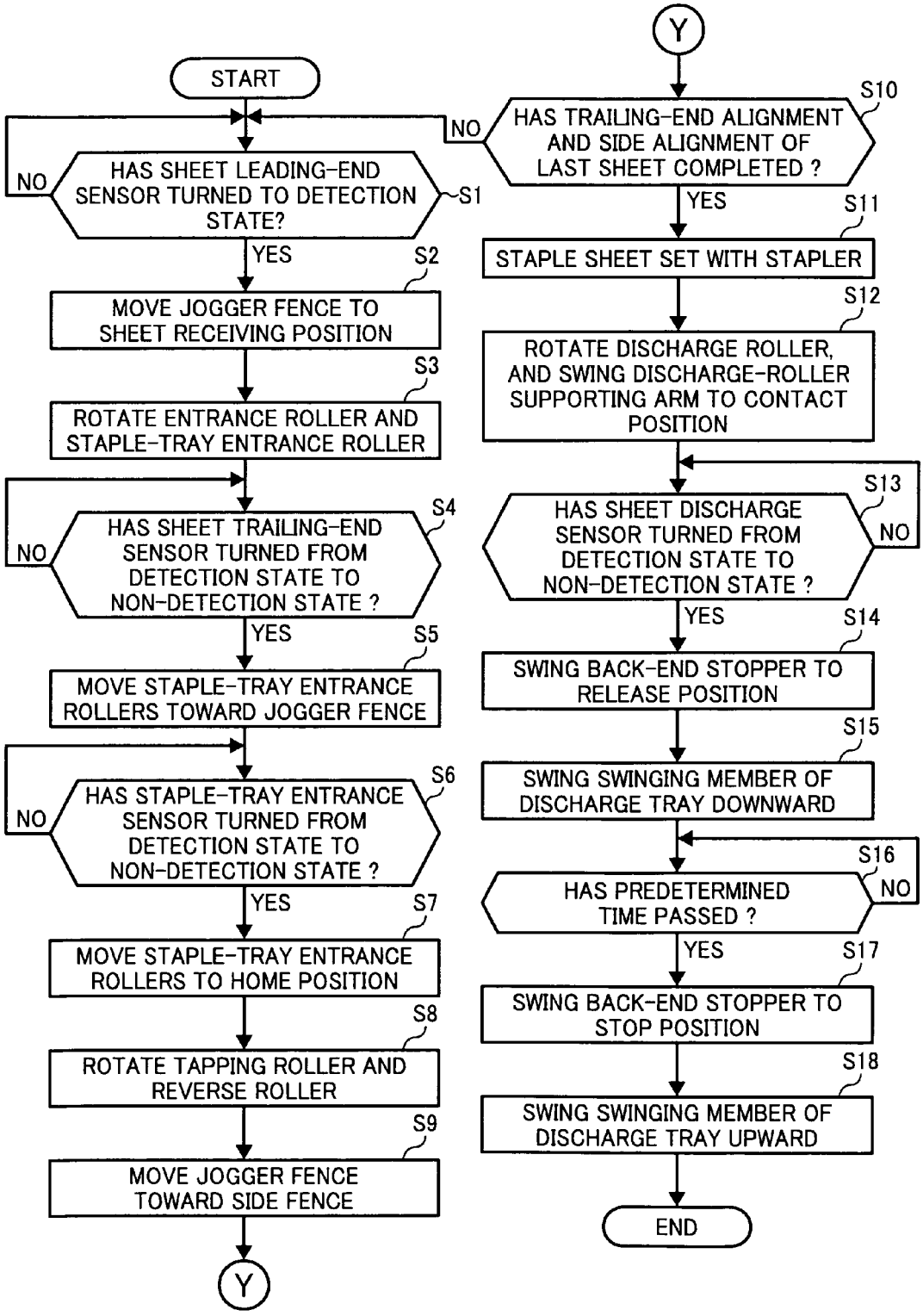
FIG. 14 is a flowchart for explaining operations performed by the sheet post-processing unit according to the first embodiment.

The operation of the sheet post-processing unit 9 is described with reference to FIG. 14. The determining unit 41 determines whether the sheet leading-end sensor 31 has turned to a detection state (Step S1). If the determining unit 41 determines that the sheet leading-end sensor 31 is still in non-detection state (No at Step S1), the process control repeats Step S1. If the determining unit 41 determines that the sheet leading-end sensor 31 has turned to the detection state (Yes at Step S1), the processing unit 55 moves the jogger fence 19 to the sheet receiving position (Step S2), and then rotates the entrance roller 12*a* and the staple-tray entrance roller 14*a* (Step S3). After passing through the sheet entrance port 4, the sheet T, as illustrated in FIG. 2, is conveyed downstream, nipped by the entrance rollers 12*a* and 12*b* and the staple-tray entrance rollers 14*a* and 14*b*. The determining unit 41 determines whether the sheet trailing-end sensor 33 has turned from the detection state to the non-detection state (Step S4). If the determining unit 41 determines that the sheet trailing-end sensor 33 is still in the detection state (No at Step S4), the process control repeats Step S4. If the determining unit 41 determines that the sheet trailing-end sensor 33 has turned from the detection state to the non-detection state (Yes at Step S4), the processing unit 55 moves the staple-tray entrance rollers 14*a* and 14*b* from the home position H toward the jogger fence 19 (Step S5). As illustrated in FIG. 3, the sheet T, which is nipped by the staple-tray entrance rollers 14*a* and 14*b*, is moved toward the jogger fence 19 by the movement of the staple-tray entrance rollers 14*a* and 14*b* while being conveyed downstream. When the trailing end Tc has passed through the nip between the staple-tray entrance rollers 14*a* and 14*b*, the sheet T falls onto the staple tray 11. The determining unit 41 determines whether a staple-tray entrance sensor 36 has turned from the detection state to the non-detection state (whether the sheet T is placed on the staple tray 11) (Step S6). If the determining unit 41 determined that the staple-tray entrance sensor 36 is still in the detection state (No at Step S6), the process control repeats Step S6. If the determining unit 41 determined that the staple-tray entrance sensor 36 is turned from the detection state to the non-detection tray (Yes at Step S6), the staple-tray entrance rollers 14*a* and 14*b* are moved to the home position H (Step S7) as illustrated in FIG. 4. After that, the tapping roller 16 and the reverse roller 24 are rotated (Step S8) as illustrated in FIG. 5, and thus the trailing end Tc of the sheet T that is conveyed onto the staple tray 11 comes abut against the back-end fence 13 for alignment. After the alignment of the trailing end Tc, as illustrate in FIG. 6, the jogger fence 19 is moved toward the side fence 17 by the fixed distance (M+N+L) (Step S9) to align the sheet sides. The determining unit 41 determines whether the alignment of the trailing end Tc and the sheet sides of the last one of the sheet pile has completed (Step S10). If the determining unit 41 that the alignment of the trailing end Tc and the sheet sides of the last sheet has not been completed (No at Step S10), the process control returns to Step S1. In other words, the trailing-end alignment and the sheet-side alignment have performed each time when the single sheet T is conveyed to the sheet post-processing unit 9. If the determining unit 41 that the alignment of the trailing end Tc and the sheet sides of the last sheet has been completed (Yes at Step S10), the stapler 23 staples the end of the sheet pile (Step S11). After that, as illustrated in FIG. 7, the discharge roller 18*a* rotates, and the discharge-roller supporting arm 65 swings to a contact position (Step S12). Thus, the sheet pile is discharged, nipped by the discharge rollers 18*a* and 18*b*, onto the discharge tray 8. The determining unit 41 determines whether the sheet discharge sensor 35 has turned from the detection state to the non-detection state (whether the sheet pile is discharged onto the discharge tray 8) (Step S13). If the determining unit 41 determines that the sheet discharge sensor 35 is still in the detection state (No at Step S13), the process control repeats Step S13. If the determining unit 41 determines that the sheet discharge sensor 35 has turned from the detection state to the non-detection state (Yes at Step S13), the back-end stopper 29 is swung to the release position (Step S14), and then the swinging member 8*a* of the discharge tray 8 is swung downward (Step S15). By this swing, the sheet pile that is placed on the discharge tray 8 moves downward toward the upstream end of the discharge tray 8, sliding on the swinging member 8*a*. The determining unit 41 determines whether a predetermined time (e.g., 3 seconds) has passed (Step S16). If the determining unit 41 determines that the predetermined time has not passed (No at Step S16), the process control repeats Step S16. If the determining unit 41 determines that the predetermined time has passed (Yes at Step S16), as illustrated in FIG. 9, the back-end stopper 29 is swung to the stop position (Step S17), and then the swinging member 8*a* of the discharge tray 8 is swung upward (Step S18). Thus, the trailing end of the sheet pile is stopped by the back-end stopper 29.

A second case where the user selects the A4-sized sheet as the sheet T and the stapling mode with the control panel 39 is described below. The sheet-size comparing unit 43 compares the sheet size (A4 size) that is selected via the control panel 39 with the reference sheet size (B4 size). Because the selected sheet size is smaller than the reference sheet size, the roller moving-direction deciding unit 49 decides the roller moving direction in which the staple-tray entrance rollers 14*a* and 14*b* are to be moved as the sheet width direction toward the side fence 17. The roller moving-distance calculating unit 51 calculates the moving distance U of the staple-tray entrance rollers 14*a* and 14*b* in such a manner that, after the sheet T is moved, the distance between the first side Ta and the first stapler end 23*a* in the sheet width direction becomes M. The fence moving-distance calculating unit 47 calculates the moving distance V between the home position and the sheet receiving position of the jogger fence 19 in such a manner that, after the sheet T is moved, the distance between the second side Tb and the jogger fence 19 in the sheet width direction becomes N.

Figure 10:
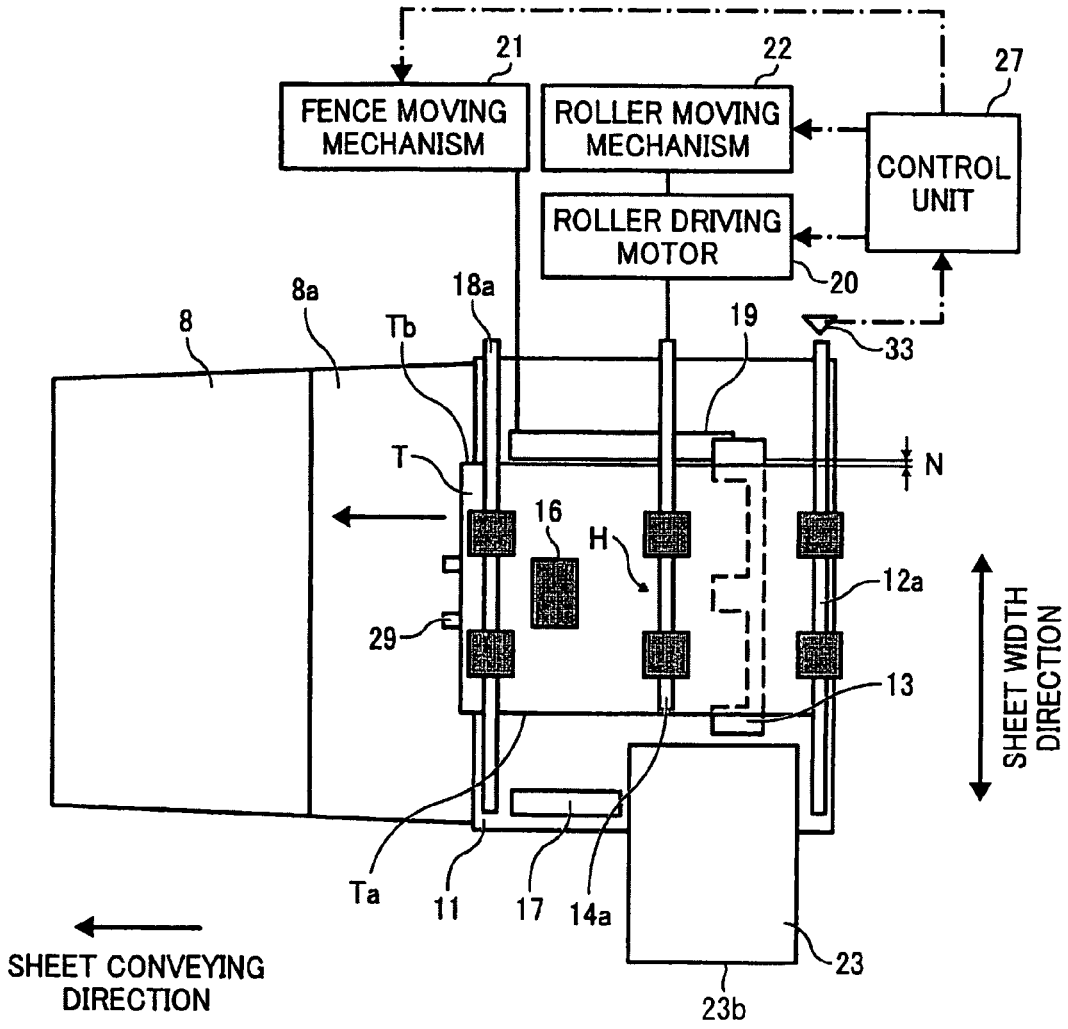
FIG. 10 is a top view of the staple tray and the relevant parts according to the first embodiment for explaining a state where before an A4-sized sheet is moved in the sheet width direction.
Figure 11:
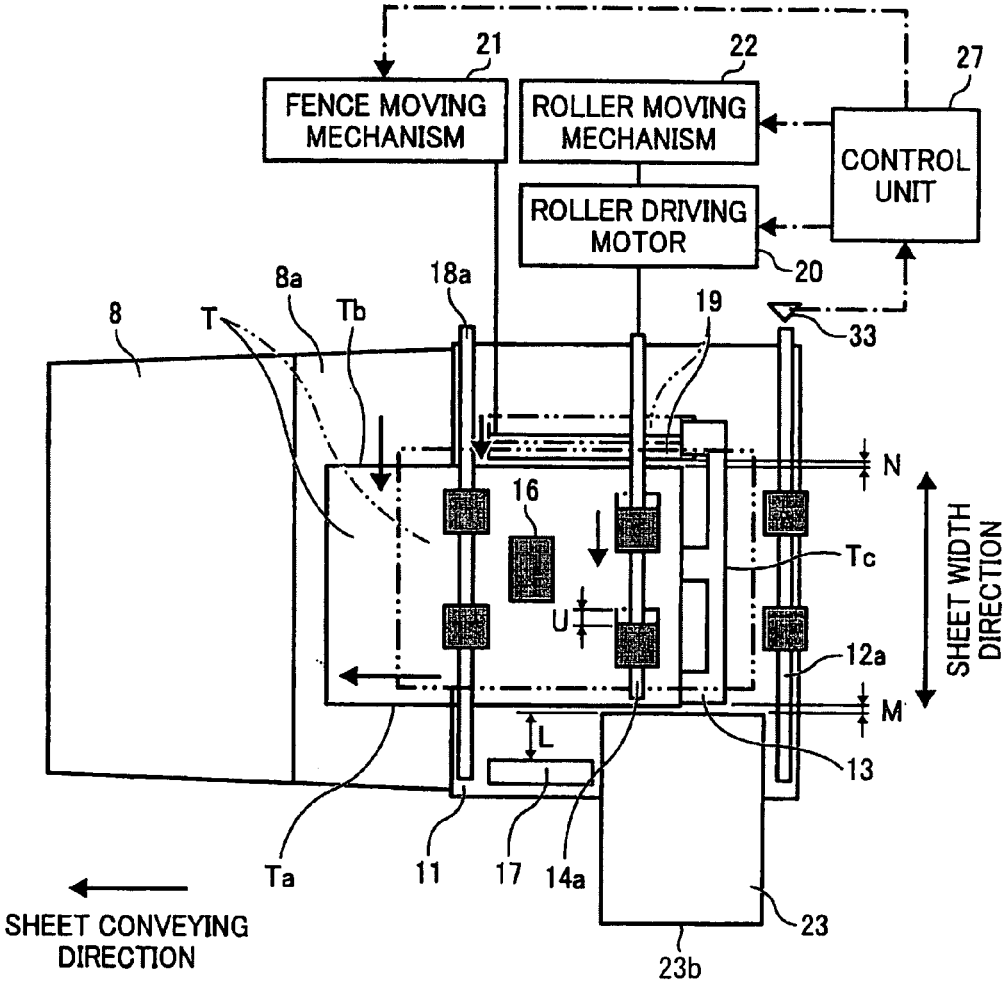
FIG. 11 is a top view of the staple tray and the relevant parts according to the first embodiment for explaining a state after the A4-sized sheet is moved in the sheet width direction.
Figure 12:
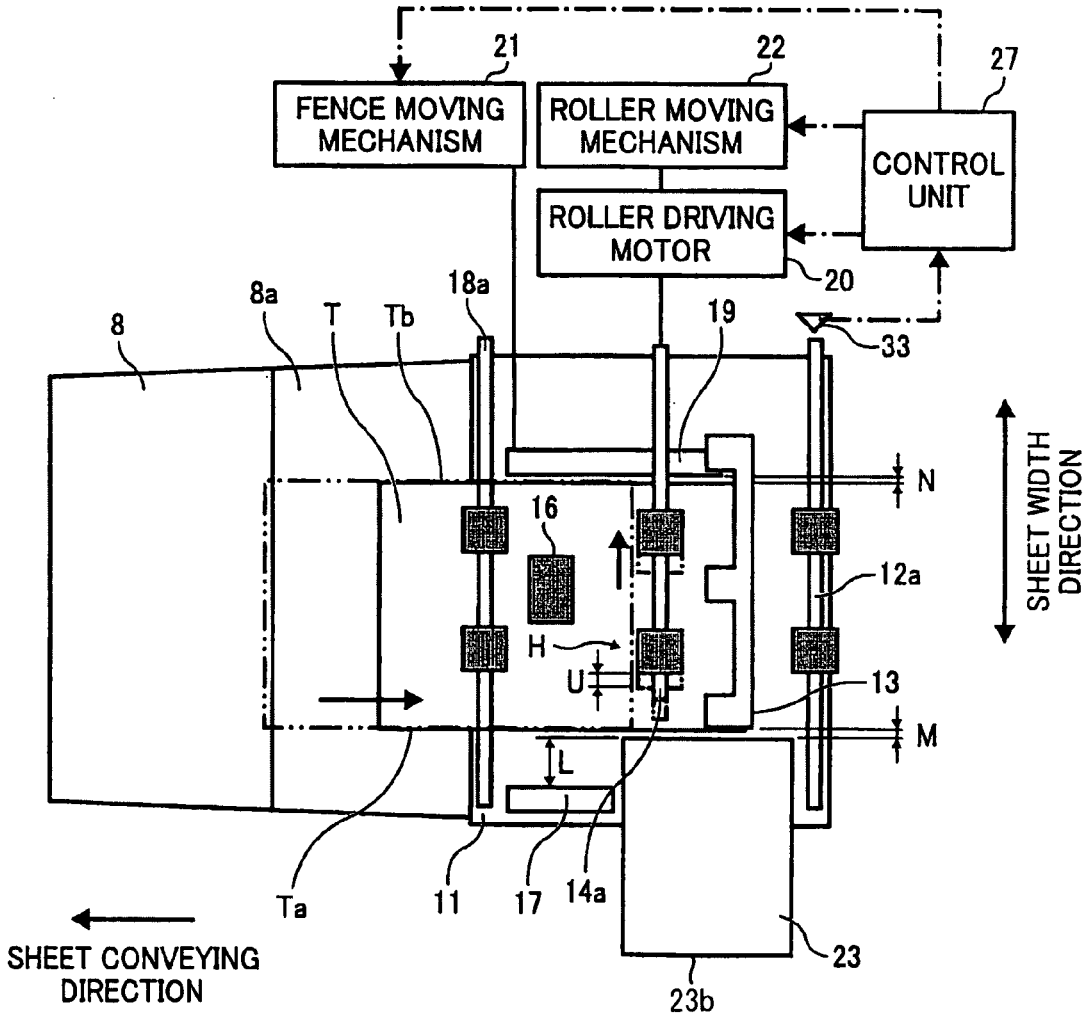
FIG. 12 is a top view of the staple tray and the relevant parts according to the first embodiment for explaining a state where the trailing end of the A4-sized sheet is aligned.
Figure 13:
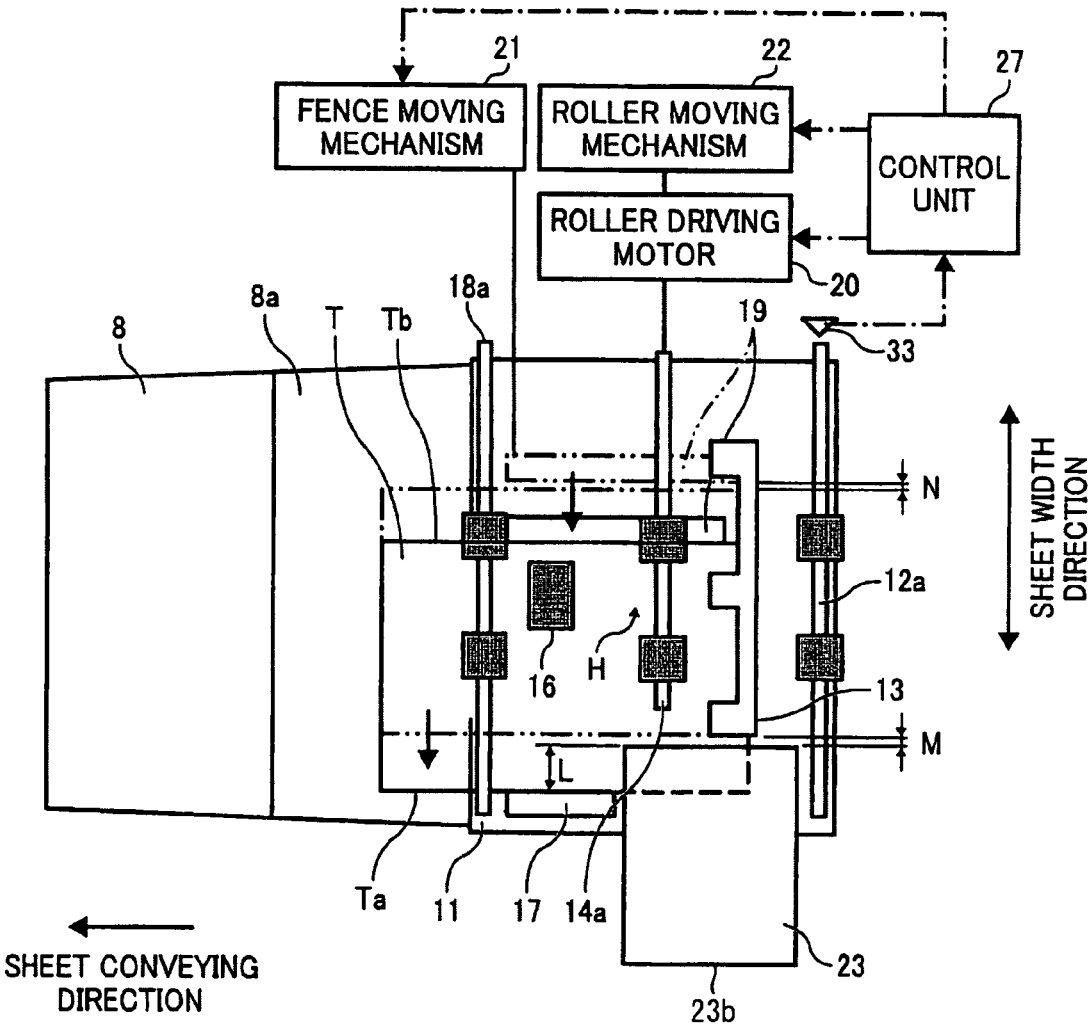
FIG. 13 is a top view of the staple tray and the relevant parts according to the first embodiment for explaining a state where the sides of the A4-sized sheet are aligned.

The operation of the sheet post-processing unit 9 in the second case where the A4-sized sheet is selected as the sheet T is almost the same as the operation in the first case that is described with reference to the flowchart illustrated in FIG. 14 where the B4-sized sheet is selected as the sheet T except for Step S5. More particularly, as illustrated in FIG. 10, after the sheet T is conveyed through the post-processing-unit conveyer path 6, when the determining unit 41 determines that the sheet trailing-end sensor 33 is turned from the detection state to the non-detection state at Step S4, the processing unit 55 moves the staple-tray entrance rollers 14*a* and 14*b* toward the side fence 17 as illustrated in FIG. 11. By the movement of the staple-tray entrance rollers 14*a* and 14*b*, the sheet T is moved toward the side fence 17 while being conveyed downstream. The sheet T is moved to the position where the distance between the first side Ta and the first stapler end 23*a* in the sheet width direction becomes M. After that, as illustrated in FIG. 12, the staple-tray entrance rollers 14*a* and 14*b* are moved to the home position H. The tapping roller 16 and the reverse roller 24 are driven, and the trailing end Tc is aligned by the movement of the tapping roller 16 and the reverse roller 24. As illustrated in FIG. 13, the jogger fence 19 is moved by the fixed distance (M+N+L) toward the side fence 17, and the sheet sides are aligned by the jogger fence 19.

A third case where the user selects the B5 sheet as the sheet T and the alignment mode with the control panel 39 is described below. The sheet-size comparing unit 43 compares the sheet size (B5 size) that is selected via the control panel 39 with the reference sheet size (B4 size). Because the selected sheet size is smaller than the reference sheet size, the roller moving-direction deciding unit 49 decides the roller moving direction in which the staple-tray entrance rollers 14*a* and 14*b* are to be moved as the sheet width direction toward the side fence 17. The roller moving-distance calculating unit 51 calculates the moving distance U of the staple-tray entrance rollers 14*a* and 14*b* in such a manner that, after the sheet T is moved, the distance between the first side Ta and the first stapler end 23*a* in the sheet width direction becomes M. The fence moving-distance calculating unit 47 calculates the moving distance V between the home position and the sheet receiving position of the jogger fence 19 in such a manner that, after the sheet T is moved, the distance between the second side Tb and the jogger fence 19 in the sheet width direction becomes N.

The operation of the sheet post-processing unit 9 in the third case where the alignment mode is selected is almost the same as the operation in the second case that is described with reference to the flowchart illustrated in FIG. 14 where the stapling mode is selected except that Step S11 is skipped in the third case. More particularly, when the determining unit 41 that the alignment of the trailing end Tc and the sheet sides of the last sheet T has completed at Step S10, the processing unit 55 rotates the discharge roller 18*a* and then swings the discharge-roller supporting arm 65 to the contact position (Step S12) without driving the stapler 23. Thus, the unstapled sheet pile with the aligned trailing end Tc and the sheet sides is displayed onto the discharge tray 8.

A fourth case where the user selects the direct discharge mode with the control panel 39 is described below. The operation of the sheet post-processing unit 9 in the fourth case where the direct discharge mode is selected only includes Steps S1, S3, and S12 to S18 of the flowchart illustrated in FIG. 14. More particularly, when the determining unit 41 determines that the sheet leading-end sensor 31 has turned to the detection state at Step S1, the entrance roller 12*a* and staple-tray entrance roller 14*a* are rotated (Step S3). After that, the discharge roller 18*a* is rotated, and the discharge-roller supporting arm 65 is swung to the contact position (Step S12). Thus, the sheet T that is received from the image forming unit 5 is discharged onto the discharge tray 8 without being subjected to any post-process. After the sheet T is discharged onto the discharge tray 8, Steps S13 to S18 are performed.

Effects of the first embodiment are described below. In the first embodiment, the stapler 23 is arranged on the first side of the staple tray 11 in the sheet conveying direction without being out of the upstream end of the staple tray 11. This arrangement of the stapler 23 makes it possible to reduce the length of the sheet post-processing unit 9 in the sheet conveying direction.

Because the stapler 23 is arranged to staple the staple position away from the trailing end Tc by the predetermined distance, it is unnecessary to move the stapler 23 in the sheet conveying direction or in the direction reverse to the sheet conveying direction when the stapler 23 staples the staple position. Moreover, because this configuration needs no mechanism for moving the stapler 23, the manufacture costs will decrease.

The first stapler end 23*a* is arranged closer to the center of the width of the staple tray 11 in the sheet width direction than the first side of the sheet T is, if the sheet T is A3 size (which is the largest size from among the receivable sizes). Therefore, a second stapler end 23*b* of the stapler 23 is positioned away outside from but relatively close to the staple tray 11 in the sheet width direction. This arrangement of the stapler 23 makes it possible to reduce the width of the sheet post-processing unit 9 in the sheet width direction.

If the sheet T that is received from the image forming unit 5 is equal to or larger than the B4-sized sheet, i.e., the first side Ta is outside of the first stapler end 23*a* in the sheet width direction toward the second stapler end 23*b*, before the sheet T is placed on the staple tray 11, the sheet T is moved under control of the control unit 27 to the position at which the first side Ta is inside of the first stapler end 23*a* in the sheet width direction toward the center of the staple tray 11. With this configuration, the sheet T is smoothly conveyed onto the staple tray 11 without overlapped with the stapler 23.

The positions of the side fence 17 and the stapler 23 in the sheet width direction are decided in such a manner that after the sheet sides are aligned by movement of the jogger fence 19 toward the side fence 17, the stapler 23 can staple an end of the aligned sheet pile. Therefore, the stapler 23 can staple the end of the sheet pile without moving in the sheet width direction. Because this configuration needs no mechanism for moving the stapler 23, the manufacture costs will decrease.

Because the jogger fence 19 is the only member that is required to move in the mechanism for aligning the sheet sides, the configuration of the fence moving mechanism 21 is simple. The simple configuration will suppress the manufacture costs.

The roller moving direction, in which the staple-tray entrance rollers 14*a* and 14*b* are to be moved, and the moving distance, by which the staple-tray entrance rollers 14*a* and 14*b* are to be moved, are decided or calculated based on information about the sheet size that is received from the image forming unit 5 in such a manner that, after the sheet T is moved in the sheet width direction, the first side Ta is positioned away from the opening 25 inside by the distance M. The jogger fence 19 is moved to the sheet receiving position that is decided in such a manner that, when the sheet T is conveyed onto the staple tray 11 after the sheet T is moved in the decided roller moving direction by the calculated moving distance, the distance between the jogger fence 19 and the second side Tb becomes N, i.e., the fixed value, even if the sheet size of the sheet T is variable. With this configuration, the distance by which the jogger fence 19 is moved to align the sheet sides is fixed to the sum of M, N, and L. This simplifies the control over the sheet-side alignment.

Before the sheet T is conveyed onto the staple tray 11, the staple-tray entrance roller 14*a* is moved to the position at which the distance between the first side Ta and the first stapler end 23*a* becomes M. Therefore, the sheet T is placed onto the staple tray 11 without overlapped with the stapler 23. Moreover, the distance by which the jogger fence 19 is moved to align the sheet sides becomes as small as possible. With this configuration, the sheet T is conveyed onto the staple tray 11 without fail, and the time required for the sheet-side alignment is reduced.

Before the sheet T is conveyed onto the staple tray 11, the jogger fence 19 is moved to the position away from the second side Tb by the distance N. Therefore, the sheet T is placed onto the staple tray 11 without overlapped with the jogger fence 19. Moreover, the distance by which the jogger fence 19 is moved to align the sheet sides is as small as possible. With this configuration, the sheet T is conveyed onto the staple tray 11 without fail, and the time required for the sheet-side alignment is reduced.

It is possible to provide an image forming system including the image forming unit 5 and the sheet post-processing unit 9 that brings the above-described effects.

The sheet post-processing unit 9 is arranged between the scanning unit 3 and the image forming unit 5. This arrangement makes it possible to reduce a required space.

A second embodiment of the present invention is described below. In the following description, parts corresponding to those in the first embodiment are denoted with the same reference numerals, and the same description is not repeated. Parts different from the first embodiment are described below.

Figure 17:
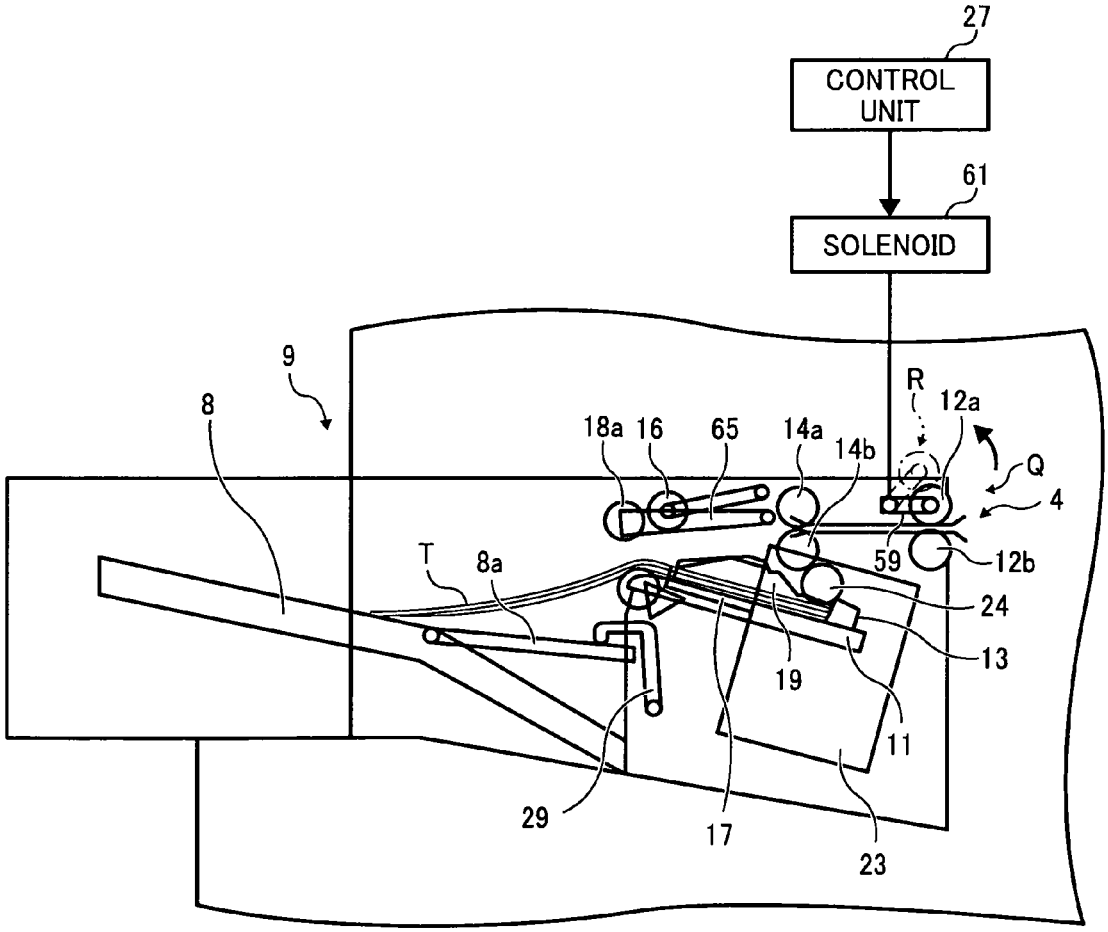
FIG. 17 is a side view of the internal configuration of a sheet post-processing unit according to a second embodiment of the present invention viewed from the sheet width direction.

The second embodiment is described with reference to FIG. 17. The entrance roller 12*a* of the second embodiment is rotatably supported by an end of an arm 59 the other end of which is swingably supported. The arm 59 is always pushed downward by a coil spring force. The arm 59 swings upward when a solenoid 61 is ON, and downward when the solenoid 61 is OFF. In other words, the entrance roller 12*a* can move between a sheet conveying position Q and a release position R that is away from the sheet conveying position Q.

In the first embodiment, the staple-tray entrance rollers 14*a* and 14*b* cannot move to the target position while the sheet T is nipped by the entrance rollers 12*a* and 12*b*. Therefore, the staple-tray entrance rollers 14*a* and 14*b* starts moving to the target position after the trailing end Tc has passed through the nip between the entrance rollers 12*a* and 12*b*. To move the staple-tray entrance rollers 14*a* and 14*b* to the target position within a period between when the trailing end Tc has passed through the nip between the entrance rollers 12*a* and 12*b* and when the trailing end Tc has passed through the nip between the staple-tray entrance rollers 14*a* and 14*b*, a speed at which the staple-tray entrance rollers 14*a* and 14*b* are moved is disadvantageously set higher than recommended speeds.

In the second embodiment, in contrast, if the sheet T coming from the image forming unit 5 has the length in the sheet conveying direction longer than the distance between the nip between the conveyer rollers 28, which is arranged in the middle of the post-processing-unit conveyer path 6, and the nip between the staple-tray entrance rollers 14*a* and 14*b* (e.g., the sheet T is A4 size), the entrance roller 12*a* is moved from the sheet conveying position Q to the release position R when the sheet leading-end sensor 31 detects the leading end of the sheet T. With this configuration, the staple-tray entrance rollers 14*a* and 14*b* can start moving to the target position after the trailing end Tc has passed through the nip between the conveyer rollers 28. Therefore, the sheet T is moved in the sheet width direction at a recommended speed.

According to the second embodiment, the entrance roller 12*a* is moved to the release position when the sheet T is nipped by the staple-tray entrance rollers 14*a* and 14*b* with the trailing end Tc having passed through the conveyer rollers 28 that are arranged immediately upstream of the entrance rollers 12*a* and 12*b* in the sheet conveying direction. With this configuration, the staple-tray entrance rollers 14*a* and 14*b* can be moved in the sheet width direction before the trailing end Tc has passed through the entrance roller 12*b*. Therefore, the speed at which the staple-tray entrance rollers 14*a* and 14*b* are moved can be set to a recommended speed by setting the timing at which the staple-tray entrance rollers 14*a* and 14*b* start moving in the sheet width direction earlier. This improves accuracy of the positional control of the staple-tray entrance rollers 14*a* and 14*b*.

The present invention is not to be limited to the present embodiments, but is to be construed as embodying all modifications and alternative constructions within the scope of the present invention. For example, it is possible to use an inkjet image forming unit that ejects ink from an ejection head onto the recording medium instead of the image forming unit 5 that transfers the toner image onto the recording medium.

Although the reference sheet size with which the sheet-size comparing unit 43 compares the selected sheet size is B4 size in the above-described embodiments, the reference sheet size can be set to some other size, such as A3 size.

Moreover, although the sheet post-processing unit 9 includes the image forming unit 5 and the scanning unit 3 as a unit, the image forming unit 5 and the scanning unit 3 can be formed in a separated manner.

Furthermore, although the image forming system 1 includes the scanning unit 3, the image forming system 1 can exclude the scanning unit 3. For example, a multifunction product (MFP) including a printer (image forming unit) and a sheet post-processing unit can be used.

According to an aspect of the present invention, a stapler is arranged on one side of a staple tray in a sheet width direction in such a manner that the stapler is inside of a downstream end of the staple tray in a sheet conveying direction. This arrangement reduces a length of a sheet post-processing unit perpendicular to the sheet width direction.

Moreover, the stapler is arranged to staple a staple position on a side of a sheet pile away from a trailing end of the sheet pile by a predetermined distance. Therefore, the stapler can staple the staple position without moving in the sheet conveying direction or a direction reverse to the sheet conveying direction. Because this configuration needs no mechanism for moving the stapler, manufacture costs will decrease.

Furthermore, because an opening of the stapler from which the sheet pile is inserted opens toward the center in the sheet width direction, a part of the stapler outside of the staple tray in the sheet width direction is suppressed. This arrangement reduces a width of the sheet post-processing unit in the sheet width direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing device that receives a sheet from an image forming apparatus and, directly discharges the sheet to outside when no post-processing is to be performed on the sheet, performs post-processing on the sheet and discharges post-processed sheet to outside when post-processing is to be performed on the sheet, the sheet post-processing unit comprising:

a tray member configured to accumulate a plurality of the sheet as a sheet pile, the tray member having a first side that is parallel to a sheet width direction;

an end aligning member having an end alignment surface configured to align trailing ends of the sheets in the sheet pile;

a stapler unit is configured to staple together the sheet pile at a second side thereof at a staple position, the stapler unit having an opening in which the second side of the sheet pile is inserted, the stapler unit being arranged near the first side of the tray member such that a central portion of the second side of the sheet pile is situated inside the opening of the stapler unit, and the staple position is located downstream of the alignment surface of the aligning member in a sheet conveying direction;

a pair of staple-tray entrance rollers that convey the sheet to the tray member;

a moving mechanism that moves the staple-tray entrance rollers in the sheet width direction;

a control unit that controls the moving mechanism, wherein the stapler unit is arranged under the staple-tray entrance rollers at a position where a central portion of a second side of a sheet pile of largest of receivable sheets is located inside the opening, and when a sheet is conveyed with a second side being outside of the opening, the control unit moves the staple-tray entrance rollers toward a third side of the tray member that is parallel to the sheet width direction before the sheet is delivered on the tray member so that the sheet can be delivered on the tray member with the second side thereof being inside of the opening; and a pair of conveyer rollers that convey the sheet from the image forming apparatus to the sheet post-processing device, the conveyer rollers being arranged upstream of the staple-tray entrance rollers and are movable between a sheet conveying position at which the conveyer rollers are in contact with the sheet and a release position that is away from the sheet conveying position.

2. The sheet post-processing device according to claim 1, further comprising:

a first side-aligning member having a side alignment surface configured to align second sides of the sheets in the sheet pile, the first side-aligning member being arranged along the first side of the tray member; and a second side-aligning member having a side alignment surface configured to align fourth sides of the sheets in the sheet pile, the second side-aligning member being arranged along the third side of the tray member so as to be movable in the sheet width direction toward the first side-aligning member, wherein the first side-aligning member and the stapler unit are positioned so that when the second side-aligning member moves toward the first side-aligning member and the side alignment surface of the second side-aligning member aligns the fourth sides of the sheets in the sheet pile the stapler unit is in a position to staple together the sheet pile.

3. The sheet post-processing device according to claim 2, wherein when a sheet is conveyed with a second side being located relatively away from the opening and toward the second side-aligning member, the control unit moves the staple-tray entrance rollers, before the sheet is delivered on the tray member, toward the first side so that the second side and the fourth side are away from the opening and toward the second side-aligning member, and the control unit decides a direction in which the staple-tray entrance rollers are to be moved and a distance by which the staple-tray entrance rollers are to be moved using data on the size of the sheet that is received from the image forming apparatus in such a manner that the first side is moved to a position away from the opening inside by a first distance and the second side-aligning member is moved to a position away from the fourth side inside by a second distance, wherein the first distance and the second distance are fixed irrespective of the size of the sheet.

4. An image forming system comprising:

an image forming apparatus that forms an image onto a sheet based on image data; and the sheet post-processing device according to any of claim 1, wherein the sheet post-processing device receives the sheet with the image from the image forming apparatus and further processes the sheet if required.

5. The image forming system according to claim 4, further comprising a scanning device that scans an original to obtain the image data, wherein the sheet post-processing device is arranged between the scanning device and the image forming apparatus.

* * * * *